US006142134A

United States Patent [19]

Meeks

[11] Patent Number: 6,142,134

[45] Date of Patent: Nov. 7, 2000

[54] ARCHERY BOW WITH PRE-CENTERED ARROW REST

[76] Inventor: Paul H. Meeks, 602 Kimbrough Dr., Tallulah, La. 71282

[21] Appl. No.: 09/318,104

[22] Filed: May 24, 1999

Related U.S. Application Data

[60] Provisional application No. 60/088,139, Jun. 5, 1988.

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 2,998,811 | 9/1961 | Sackmann | 124/24.1 |
| 3,135,255 | 6/1964 | Hoyt | 124/24.1 |
| 3,494,347 | 2/1970 | Saunders | 124/24.1 |
| 3,698,375 | 10/1972 | Brougham | 124/24.1 |
| 4,182,513 | 1/1980 | Henderson | 473/586 |
| 4,332,232 | 6/1982 | Troncoso, Jr. | 124/24.1 |
| 4,662,346 | 5/1987 | Laffin | 124/44.5 |
| 5,022,378 | 6/1991 | Rhodehouse et al. | 124/44.5 |
| 5,140,972 | 8/1992 | Fisk | 124/44.5 |
| 5,190,023 | 3/1993 | Sacco | 124/44.5 |
| 5,205,267 | 4/1993 | Burdick | 124/24.1 |
| 5,353,778 | 10/1994 | Blankenship | 124/44.5 |
| 5,386,814 | 2/1995 | Denton | 124/44.5 |
| 5,400,763 | 3/1995 | Mazza | 124/44.5 |
| 5,555,875 | 9/1996 | Martin et al. | 124/44.5 |

OTHER PUBLICATIONS

Golden Key–Futura Archery Products 1996 catalog.
Golden Key–Futura Archery Products 1994 catalog.

*Primary Examiner*—John A. Ricci
*Attorney, Agent, or Firm*—Akin, Gump, Strauss, Hauer & Feld, L.L.P.

[57] ABSTRACT

In an archery bow, a handle riser includes a generally horizontally extending shelf forming the base of a sight window and having plural sets of threaded bores, and/or alignment pins thereon or a tongue or groove formed thereon for receiving a preset arrow holder or arrow rest to be aligned with the draw plane of the bow. The arrow holder may also be mounted on an intermediate rest member which may be mounted on the shelf in a selected position to extend the overdraw capability of the arrow rest. The arrow holder may be supported on an extension member mounted on a rearward face of the shelf. The shelf of the handle riser, the rest member, the extension member and the arrow holder are all prefabricated for connection of these members to provide an arrow rest which is pre-centered in the bow draw plane or may determine the bow draw plane for bows with adjustable bow string supports and adjustable limbs.

14 Claims, 4 Drawing Sheets

ARCHERY BOW WITH PRE-CENTERED ARROW REST

CROSS REFERENCE TO RELATED APPLICATION

This application claims priority under 35 U.S.C. 119(e) (1) of provisional application Ser. No. 60/088,139 filed Jun. 5, 1998.

FIELD OF THE INVENTION

The present invention pertains to an archery bow handle riser including an arrow rest pre-centered in the draw plane of the bow.

BACKGROUND

Hunting and sport archers have a preeminent objective, that being accuracy of the flight of the arrow to its intended target. In this regard, a wide variety of arrow rest devices have been developed for supporting the arrow on the bow in the sight window. Conventional arrow rests include relatively complicated adjustment devices, are typically mounted on the side of the handle riser and require expensive and time consuming setup and adjustment to provide proper alignment with the draw plane of the bow string. Prior art arrow rest devices and arrangements require the user of the bow to be particularly skilled at installing arrow rests and sights and aligning these devices with the draw plane of the bow string. Typically, a professional installer must be employed to perform this operation.

Accordingly, there has been a desire to simplify the requirements of archery bows with regard to the location of arrow rests and holders to minimize the expense connected with the sport of archery and to provide convenience in purchasing and using archery equipment. It is to these ends that the present invention has been developed.

SUMMARY OF THE INVENTION

The present invention provides an improved archery bow or bow handle riser which is provided with an improved preset arrow rest which is centered in the draw plane of the bow.

In accordance with one aspect of the invention, a bow handle riser is provided with a transverse fore and aft extending shelf at the base of the sight window which includes predetermined support and connecting means for supporting an arrow rest centered in the draw plane of the bow. The handle riser may include a plurality of threaded bores formed in the shelf, may include suitable alignment indicia on the shelf for receiving an arrow rest, and include an extension member for positioning the arrow rest in a desired fore and aft position, depending on the length of the arrow and the overdraw requirements of the bow.

The present invention also provides an arrow rest for an archery bow which is prefabricated to be mounted on the bow in a centered position in the draw plane but being adjustable in a fore and aft direction with respect to the launching and flight path of the arrow. In this way an archery bow may be provided wherein the arrow rest is preset and centered on the horizontal plane of the above-mentioned shelf and also centered in the draw plane of the bow. This arrangement provides for making minute adjustments to the bow string support structure, if needed, mounting various types of sights on the bow and performing other operations which improve the accuracy of the flight of the arrow to the target.

Accordingly, the present invention eliminates the need for the user of the bow to purchase an aftermarket arrow rest, mount it, or have it mounted, and perform the complicated adjustments required to center the rest in relation to the so-called draw plane or center plane of the limbs of the bow. Thus, the present invention provides a commercially viable product which enjoys competitive and commercial advantages over prior art archery apparatus.

Those skilled in the art will further appreciate the above-mentioned advantages and superior features of the invention together with other important aspects thereof upon reading the detailed description which follows in conjunction with the drawings.

DETAILED DESCRIPTION OF PREFERRED EMBODIMENTS

Figure 1:
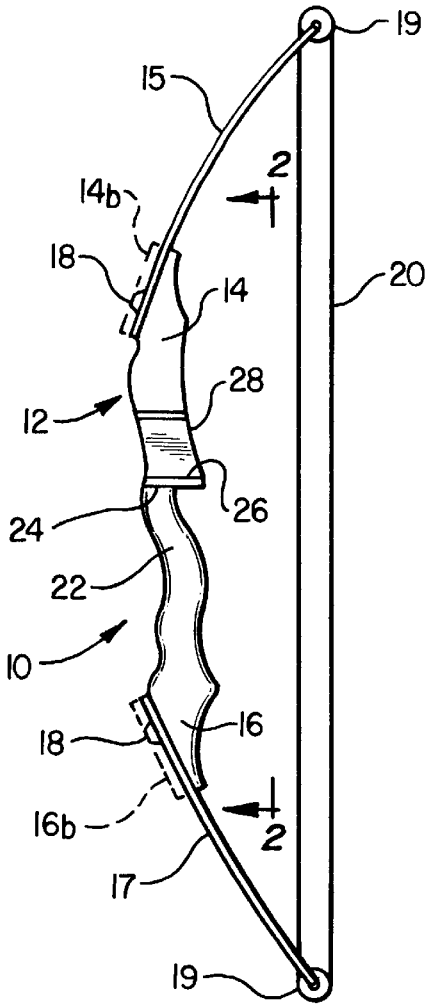
FIG. 1 is a side elevation of an archery bow including the handle riser associated with the improved arrow rest of the present invention.

In the description which follows, like elements are marked throughout the specification and drawings with the same reference numerals, respectively. The drawing figures are not necessarily to scale and certain elements may be shown in somewhat schematic or generalized form in the interest of clarity and conciseness.

Referring to FIG. 1, there is illustrated a side elevation of an archery bow 10 including a handle riser 12 in accordance with the invention. The handle riser 12 includes opposed, generally coplanar arm portions 14 and 16 which are suitably fixed to opposed bow limbs 15 and 17, respectively. The tips of the bow limbs 15 and 17 support suitable support structure, such as pulleys 19 for a bow string 20. The bow limbs 15 and 17 may be secured to the handle riser 12 in a conventional manner including threaded fasteners 18. Conversely, the handle riser 12 may be modified to provide channel-like recesses 14*b* and 16*b* on each of the arm portions 14 and 16, respectively, in which the limbs 15 and 17 are nested and, thus, are rigidly fixed for extension in a predetermined plane which includes the bow string 20. The cam wheels or pulley 19 or other suitable means for securing the bow string 20 to the bow limbs 15 and 17 also provide for movement of the bow string 20 in a predetermined draw plane P, see FIG. 2, when the string is drawn back and released. Accordingly, the draw plane is that in which the bow string moves to launch an arrow, not shown. The draw plane P is typically, centered with respect to the width of the bow limbs 15 and 17 and the handle riser 12 as shown in FIG. 2.

Figure 2:
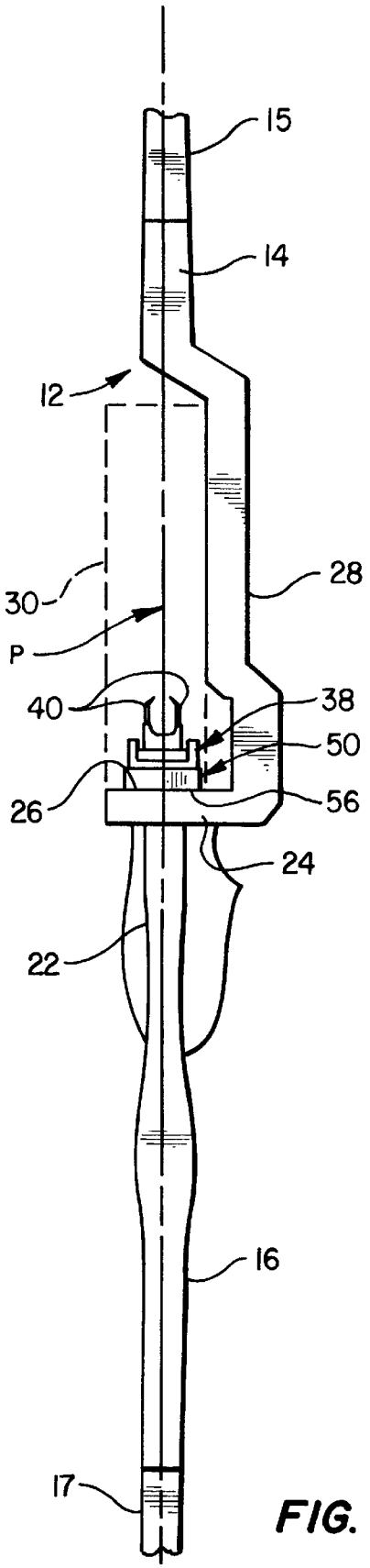
FIG. 2 is a view taken generally from the line 2—2 of FIG. 1.

Referring further to FIGS. 1 and 2, the handle riser 12 includes an integral hand grip 22 disposed below a generally horizontally extending integral shelf part 24 having a planar support surface 26 which extends normal to the plane P. The shelf 24 is connected to a vertically extending offset portion 28 of the handle riser, which offset portion is connected to the arm 14, preferably integrally formed therewith, and provides a sight window 30, FIG. 2, for the bow 10. The sight window 30 is illustrated genrerally, by the dashed line in FIG. 2.

Figure 3:
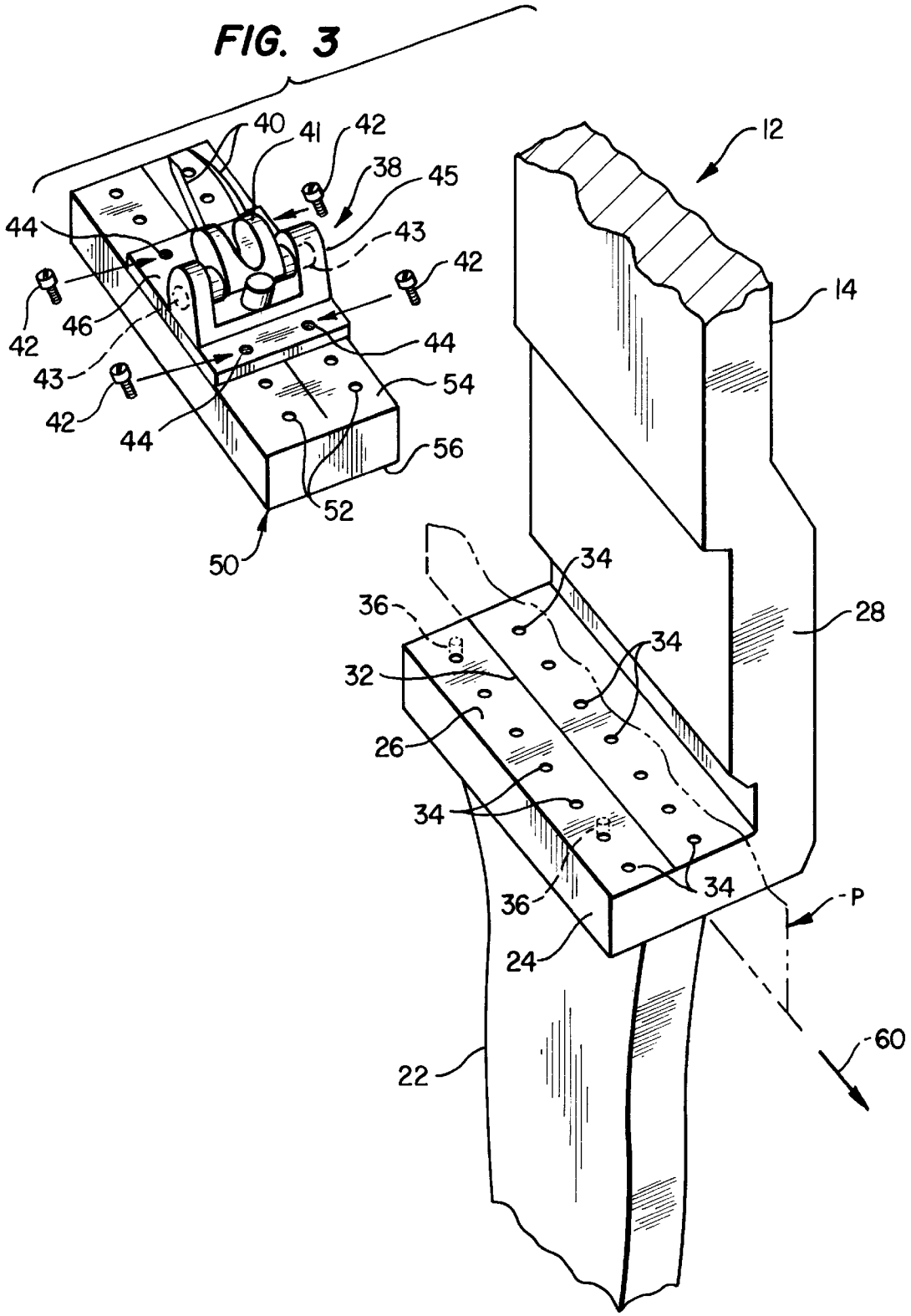
FIG. 3 is an exploded perspective view showing one preferred embodiment of the improved preset arrow rest of the invention.

Referring now to FIGS. 2 and 3, the handle riser 12 is provided with improved mounting means for pre-mounting and presetting, in the plane P, an arrow rest and holder. In particular, the shelf 24 including the horizontal planar surface 26, is provided with a suitable alignment indicia 32 which lies in the plane P. Two rows of spaced apart threaded bores 34 are preferably disposed on either side of the indicia line 32. Alternatively, one or more of the bores 34 may be replaced by prefabricated and installed alignment pins 36 projecting normal from the surface 26. An arrow rest and holder assembly 38, FIGS. 2 and 3, including spaced apart arrow support and launcher arms 40 may be mounted directly on the surface 26 of shelf 24 and secured thereto by threaded fasteners 42 which are received in the threaded bores 34. The fasteners 42 are adapted to project through predetermined and pre-spaced bores 44 formed in a planar base part 46 of the holder 38. The holder 38 may take various forms and be provided with various configurations of arrow launcher prongs or arms which may or may not move out of the way of the arrow trajectory as the arrow leaves the rest when launched. Examples of prior art arrow rests which include launcher and support members which may be used with the present invention are commercially available from Golden Key-Futura, Inc., Montrose, Colo., for example. The arms 40 may be mounted on a yoke-like base 41 which is mounted on opposed trunnions 43 supported by a clevis bracket 45 forming part of the arrow rest or holder 38.

Accordingly, the arrow rest or holder 38 may be mounted directly on the shelf 24 and, thanks to the presetting of the bores 34 and the bores 44 on the base 46, an arrow rest is provided which is preset in the draw plane P and does not require any adjustment or complex adjustment devices, as with prior art arrow rests.

The present invention also contemplates that the arrow rest may include a generally rectangular block member 50, FIGS. 2 and 3, which includes a plurality of spaced apart and aligned bores 52 extending through the member 50 between opposed spaced apart parallel planar surfaces 54 and 56. Accordingly, the rest member 50 may be mounted on the surface 26 and the arrow rest and holder 38 mounted on the rest member 50, as illustrated in FIG. 2. In this regard the threaded fasteners 42 are of sufficient length to extend through the base 46, the member 50 and into the bores 34 in the shelf 24. Still further, one or more of the bores 52 may be of sufficient diameter to receive one of the alignment pins 36, if such are used in place of relying on the precision of the bores 34, 52 and 44. However, conventional manufacturing techniques permit attainment with high accuracy of a predetermined position of the bores 34, 52 and 44 so that the rest member 50 and the arrow holder 38 may be accurately pre-positioned in the draw plane P for the bow 10.

Moreover, the provision of the rest member 50 allows positioning the rest member in a fore and aft direction with respect to the shelf 24 so that, for example, the member 50 may be extended rearwardly in the direction of arrow 60, FIG. 3, extending in cantilever fashion from the shelf 24 but supported thereon by suitable threaded fasteners extending through at least a pair of the bores 52 and into a cooperating pair of the bores 34. In this way also, the arrow holder 38 may be positioned longitudinally in a selected position along the length of the rest member 50 to accommodate longer or shorter arrows and to provide for support of an arrow in an overdrawn condition.

Accordingly, the arrow holder 38 may be mounted directly en the shelf 24 in a preset position in the draw plane or center plane P for the bow 10 and the handle riser 12 or the rest member 50 may be utilized to support the arrow holder 38 in a selected fore and aft position on the shelf 24.

Figure 4:
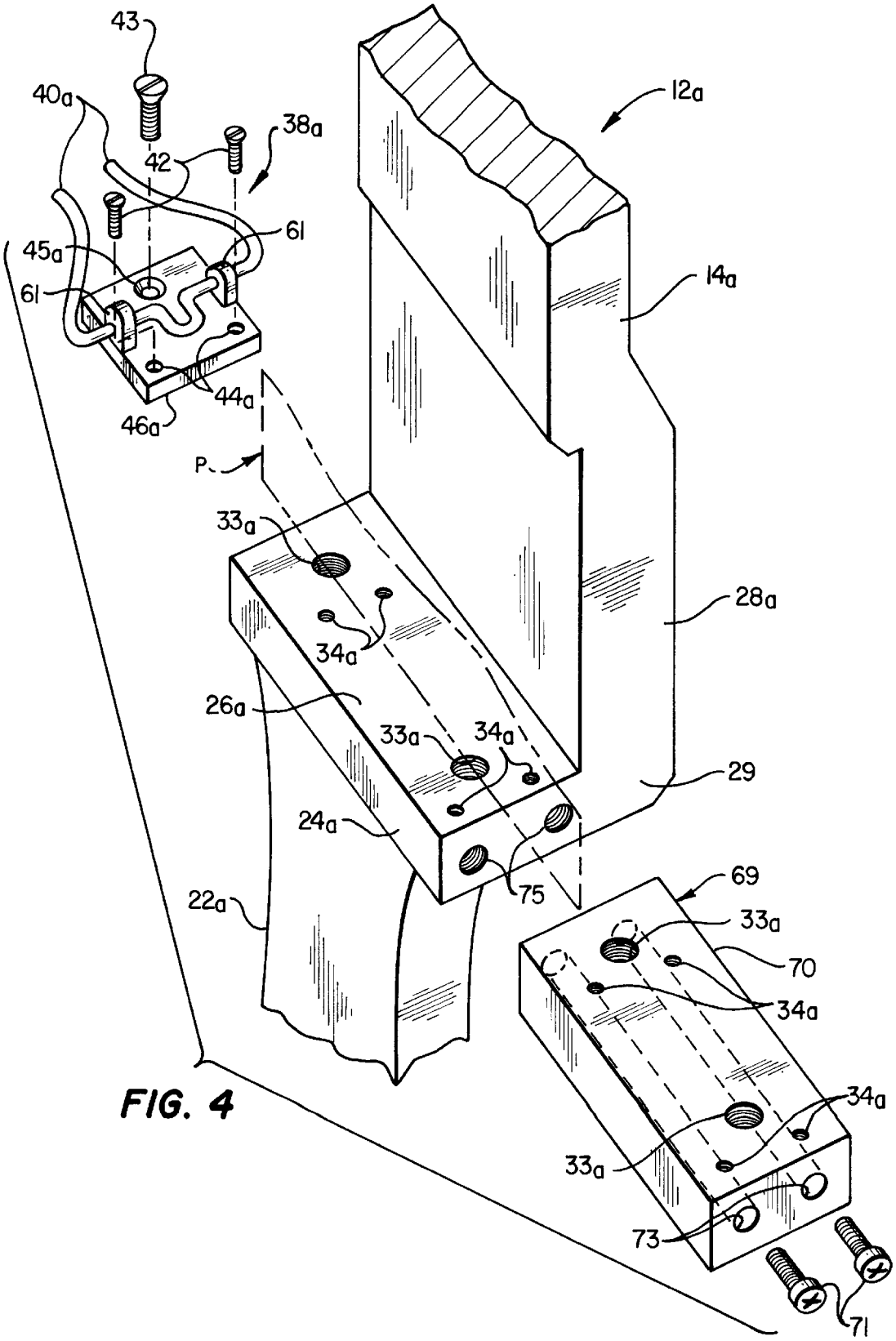
FIG. 4 is an exploded perspective view of a first alternate embodiment of the present invention.

Referring now to FIG. 4, an alternate embodiment of the invention is illustrated wherein a modified handle riser 12*a* includes an offset portion 28*a* and a hand grip 22*a*. A part of an upper arm 14*a* is shown in FIG. 4. Handle riser 12*a* also includes a generally horizontally extending shelf 24*a* having a planar surface 26*a* which is pre-fabricated to extend normal to the draw plane P of a bow utilizing the handle riser 12*a*, substantially in the same manner as the bow 10 utilizes the handle riser 12. Shelf surface 26*a* has plural spaced apart threaded bores 33*a* and 34*a* arranged in predetermined sets of bores, as shown, aligned with the plane P. An arrow holder 38*a* includes a generally rectangular planar base member 46*a* with spaced apart bores 44*a* and 45*a* which match the bores 34*a* and 33*a*, respectively. Suitable threaded fasteners 42 and 43 are operable to secure the holder 38*a* to the shelf 24*a* in a predetermined pre-aligned position with respect to the plane P. The arrow holder 38*a* has cooperating arrow support and launcher arms or prongs 40*a*which are mounted on the base 46*a* on spaced apart support brackets 61 as illustrated in FIG. 4.

The embodiment shown in FIG. 4 also includes an overdraw extension member 69 which may be secured to the aft end face 29 of the shelf 24*a*. The overdraw member 69 includes spaced apart sets of bores 33*a* and 34*a*, as illustrated, in a planar surface 70 formed thereon and which is adapted to be coplanar with the surface 26*a* when the overdraw member 69 is secured to the end face 29 by suitable threaded fasteners 71. Fasteners 71 are of sufficient length to extend through bores 73 formed in the member 69 and engaged with threaded bores 75 formed in the end face 29. Accordingly, for a bow which requires an overdraw member to support shorter arrows, the preset arrow rest or holder 38*a* may be mounted on the overdraw member 69 which, of course, is mounted on the handle riser 12*a*. The prefabrication of the holder 38*a* and the overdraw member 69 provides for alignment of the respective sets of bores in the overdraw member with the sets of fastener receiving bores in the holder base 46*a* so that the arrow holder may be preset in the draw plane P regardless of whether or not it is mounted on the shelf 24*a* or on the overdraw member 69.

Figure 5:
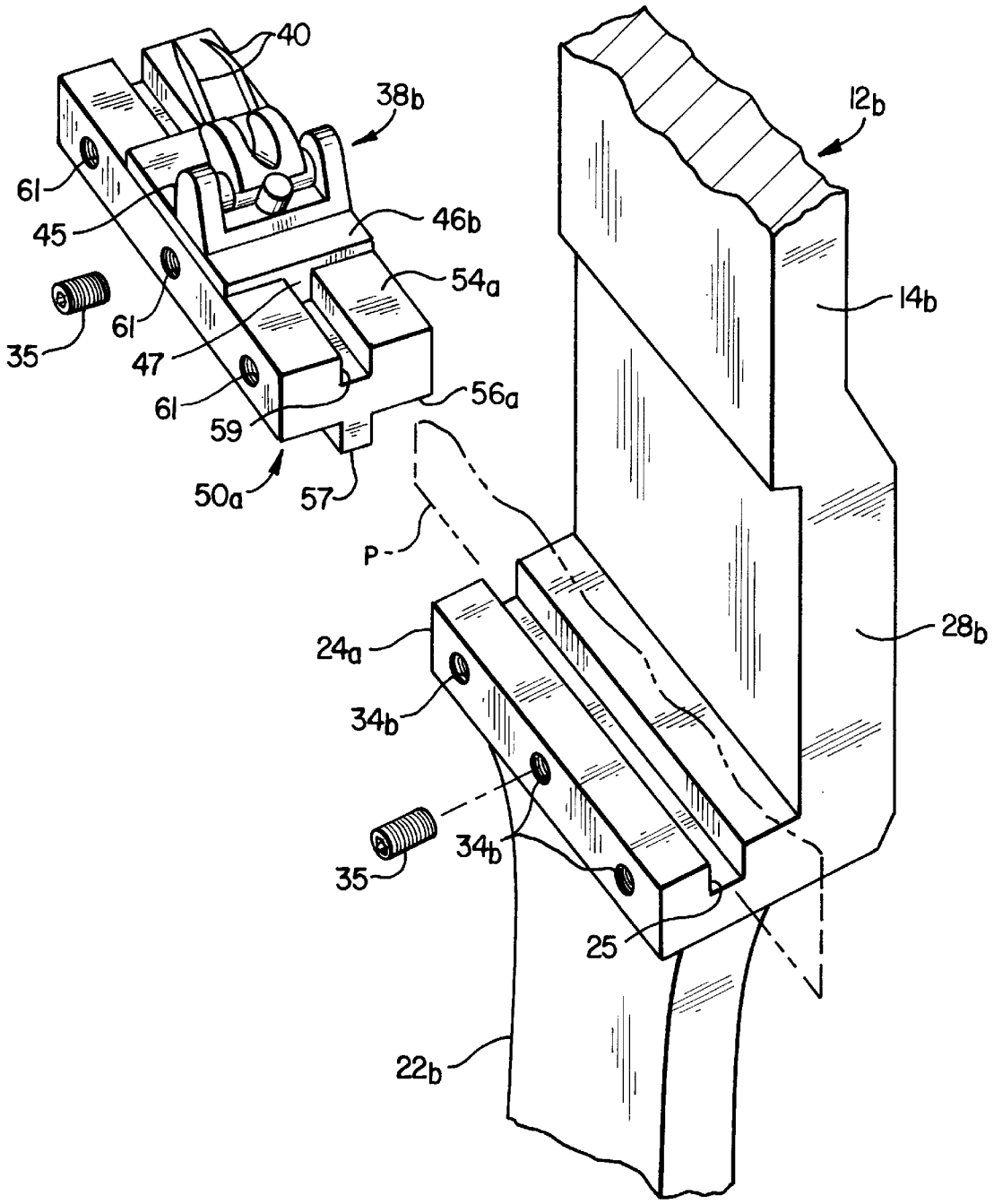
FIG. 5 is an exploded perspective view of a second alternate embodiment of the present invention.

Referring now to FIG. 5, a second alternate embodiment of the invention is illustrated wherein a handle riser 12*b* is provided which is similar to the handle riser 12*a* except that a shelf portion 24*a* is provided with a longitudinal, rectangular cross section groove 25 centered in the draw plane P and extending in a fore and aft direction across the shelf. The handle riser 12*b* includes an offset portion 28*b* connected to an upper arm 14*b*, a hand grip 22*b* and is otherwise like the handle riser 12 except as noted. Still further, the shelf 24*a* is provided with spaced apart laterally extending threaded bores 34*b* for receiving one or more sockethead set screws 35, one shown in FIG. 5.

As further shown in FIG. 5, the second alternate embodiment of the invention includes a rest member 50*a*, similar to the rest member 50 and including opposed, generally horizontal coplanar surfaces 54*a* and 56*a*. An elongated tongue or key portion 57 having substantially the same cross sectional dimensions as the groove 25 projects from the surface 56*a* and a parallel and coextensive groove 59 is formed in the rest member 50*a* and intersects the surface 54*a*. Plural spaced apart laterally extending threaded bores 61 are formed in the rest member 50*a* and intersect the groove 59 for receiving one or more sockethead set screws 35. Still further, the embodiment shown in FIG. 5 includes a modified arrow holder 38*b* which is substantially like the arrow holder 38 except a base part 46*b* is provided in place of the base 46 and includes a downwardly projecting elongated rectangular cross section tongue part 47 which is dimensionsed to be a slidable but snug fit in the groove 59 or in the groove 25.

Accordingly, those skilled in the art will recognize that the arrow rest or holder 38*b* may be mounted directly on the shelf 24*a* in a selected fore and aft position and secured thereto by one or more set screws 35 or, alternatively, the rest or holder 38*b* may be mounted on the rest member 50*a* in a selected longitudinal position and the rest member 50*a* mounted on the shelf 24*a* also in a selected working position. The respective elements 38*b* and 50*a* described are secured in their working positions by one or more set screws 35 projecting through bores 61 and 34*b*, respectively.

Those skilled in the art will also recognize that the configuration of the elements described above with respect to FIG. 5 may be reversed in the sense that the shelf 24*a* may be provided with an upward projecting elongated tongue, the rest member 50*a* may be provided with a slot or groove intersecting the surface 56*a* for receiving a tongue on shelf 24*a* and the rest member 50*a* may be modified to have an upward projecting tongue or key part projecting from the surface 54*a* and disposed in a slot formed in the base member 46*b*. In either case, the embodiment described above in conjunction with FIG. 5 provides for a preset or pre-centered arrow rest which enjoys all of the advantages of the embodiments illustrated in FIGS. 3 and 4.

The bow 10, the handle risers 12, 12*a* and 12*b*, the arrow rests or holders 38, 38*a* and 38*b* and the members 50, 50*a* and 69 may be fabricated using conventional engineering materials suitable for archery apparatus. The prefabrication of the handle risers 12, 12*a* and 12*b*, as well as the arrow holders 38, 38*a* and 38*b*, and the members 50, 50*a* and 69 may be carried out using conventional fabrication methods with very low dimensional tolerances suitable for the precision required in target and hunting archery equipment. Accordingly, archery bows may be fabricated with preset arrow rests in accordance with the invention which eliminate the requirement of adjusting complex prior art arrow rest devices, as will be appreciated by those skilled in the art.

Although preferred embodiments of the invention have been described in detail herein, those skilled in the art will recognize that various substitutions and modifications may be made to the invention without departing from the scope and spirit of the appended claims.

What is claimed is:

1. In an archery bow, a handle riser for supporting opposed bow limbs, said handle riser including a hand grip and opposed arm portions extending therefrom, an offset portion providing a sight window disposed between said arm portions and a support shelf for an arrow rest including a surface extending in a plane substantially normal to a draw plane of said bow, the improvement comprising:

a shelf extension member adapted to be releasably connected to said handle riser at said shelf in a rearward disposed position with respect to said shelf and the direction of flight of an arrow shot from said bow for supporting an arrow rest on a surface of said extension member in an extended overdraw position on said handle riser; and an arrow rest adapted to be supported on one of said surface of said shelf and said surface of said extension member in a selected one of plural fore and aft predetermined positions available on said shelf and said extension member and aligned with said draw plane, said arrow rest including an arrow holder having a base adapted to be supported in a position wherein said arrow holder is aligned with said draw plane, and fasteners for securing said arrow holder to said one of said shelf and said extension member in said selected one of said predetermined positions.

2. In an archery bow, a handle riser for supporting opposed bow limbs, said handle riser including a hand grip and opposed arm portions extending therefrom, a support shelf for an arrow rest including one of a longitudinal tongue and groove extending substantially parallel to a draw plane of said bow, and an arrow rest adapted to be supported on said shelf in a predetermined position aligned with said draw plane, said arrow rest including an arrow holder having a base member including one of a longitudinal tongue and groove operable to be slidably disposed on said shelf in registration with said one of said tongue and groove on said shelf.

3. The invention set forth in claim 2 including:

a rest member including opposed, generally planar parallel surfaces having, respectively, one of an elongated tongue and groove formed thereon and cooperable with said one of said tongue and groove on said shelf and on said arrow holder, respectively, for supporting said arrow holder on said shelf in a predetermined position aligned with said draw plane.

4. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest including an arrow holder having a base adapted to be supported on said surface of said shelf in a predetermined position wherein said arrow holder is aligned with said draw plane, said shelf including spaced apart sets of threaded bores arranged in fore and aft positions and said base of said arrow holder includes spaced apart bores aligned with at least one set of said bores in said shelf for receiving fasteners for securing said arrow holder to said shelf in a selected fore and aft position of said arrow holder while maintaining said arrow holder in said draw plane.

5. The invention set forth in claim 4 wherein:

said shelf and said base include cooperable alignment pin and alignment bore means for aligning said arrow holder on said shelf in said predetermined position.

6. In an archery bow, a handle riser for supporting opposed bow limbs, said handle riser including a hand grip, oppoeed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest including an arrow holder having a base adapted to be supported on said surface of said shelf in a position wherein said arrow holder is aligned with said draw plan; and a rest member including opposed, generally planar parallel surfaces adapted to be supported on said shelf between said arrow holder and said shelf, said rest member including spaced apart sets of bores cooperable with spaced apart sets of bores on said shelf for positioning said rest member in a selected fore and aft position on said shelf and for positioning said arrow holder in a selected fore and aft position on said rest member to accommodate an overdrawn arrow position when using said bow.

7. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest adapted to be supported on said surface of said shelf in a predetermined position aligned with said draw plane; and a shelf extension member adapted to be connected to said shelf in a rearward disposed position with respect to the direction of flight of an arrow shot from said bow for supporting said arrow rest in an extended overdraw position on said handle riser, said shelf extension member including spaced apart fastener receiving bores for receiving threaded fasteners to releasably secure said shelf extension member in a predetermined position connected to said shelf.

8. The invention set forth in claim 7 wherein:

said shelf extension member includes a planar surface thereon operable to be coplanar with said surface on said shelf when said shelf extension member is connected to said shelf.

9. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest adapted to be supported on said surface of said shelf in a predetermined position aligned with said draw plane; and a shelf extension member adapted to be supported on said shelf in a rearward disposed position with respect to the direction of flight of an arrow shot from said bow for supporting said arrow rest in an extended overdraw position, said shelf extension member including spaced apart sets of bores formed thereon for receiving said arrow rest.

10. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest adapted to be supported on said surface of said shelf in a predetermined position aligned with said draw plane; and indicia on said shelf aligned with said draw plane.

11. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest adapted to be supported on said surface of said shelf in a predetermined position aligned with said draw plane;

said shelf includes one of a longitudinal tongue and groove parallel to said draw plane; and said arrow rest includes an arrow holder having a base member including one of a longitudinal tongue and groove operable to be slidably disposed on said shelf in registration with said one of said tongue and groove on said shelf.

12. The invention set forth in claim 11 including:

a rest member including opposed, generally planar parallel surfaces having, respectively, one of an elongated tongue and groove formed thereon and cooperable with said one of said tongue and groove on said shelf and on said arrow holder, respectively, for supporting said arrow holder on said shelf in a predetermined position aligned with said draw plane.

13. The invention set forth in claim 12 including:

at least one bore formed in one of said base member and said rest member for receiving a set screw to secure said arrow rest to said shelf in a predetermined position.

14. In an archery bow, a handle riser for supporting opposed bow limbs, said handle riser including a hand grip, opposed arm portions extending therefrom, an offset portion providing a sight window disposed between said arm portions and a support shelf for an arrow rest including a substantially planar surface extending in a plane substantially normal to a draw plane of said bow, the improvement comprising:

an arrow rest including an arrow holder adapted to be supported on said surface of said shelf in a predetermined position wherein said arrow holder is aligned with said draw plane; and said shelf and said arrow rest include cooperating members thereon, respectively, cooperable to provide for supporting said arrow rest in a selected one of plural predetermined fore and aft positions on said shelf and for securing said arrow holder to said shelf in said selected fore and aft position of said arrow holder while maintaining said arrow holder in said draw plane.

* * * * *